US007097254B2

(12) United States Patent
Hobb et al.

(10) Patent No.: US 7,097,254 B2
(45) Date of Patent: Aug. 29, 2006

(54) HEIGHT-ADJUSTMENT MECHANISM FOR AN ARMREST

(75) Inventors: David Lloyd Hobb, Waterloo (CA); Gerard J. Matern, Waterloo (CA); Gerard Helmond, Waterloo (CA); Arthur A. Patton, Waterloo (CA); Cuong Quoc Vo, Waterloo (CA); David Watkins, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 10/696,513

(22) Filed: Oct. 29, 2003

(65) Prior Publication Data

US 2005/0093359 A1 May 5, 2005

(51) Int. Cl.
*A47C 7/54* (2006.01)

(52) U.S. Cl. ..... 297/411.36

(58) Field of Classification Search ..... 248/118.3, 248/408, 409, 157, 423, 297.31, 407; 297/411.36, 297/411.35, 411.2, 463.1, 411.37, 410, 406, 297/353, 383; 403/109.2, 109.1, 105
See application file for complete search history.

(56) References Cited

U.S. PATENT DOCUMENTS 5,318,347 A * 6/1994 Tseng ..... 297/411.36
5,368,365 A * 11/1994 Feldberg ..... 297/411.36
5,588,766 A * 12/1996 Lai ..... 403/105
5,765,920 A * 6/1998 Lai ..... 297/411.36
5,997,093 A * 12/1999 Gollin et al. ..... 297/411.36
6,062,647 A * 5/2000 Mei ..... 297/411.36
6,139,107 A * 10/2000 Lee ..... 297/411.36
6,264,276 B1 * 7/2001 Chen ..... 297/353
6,460,932 B1 * 10/2002 Kopish et al. ..... 297/411.36

FOREIGN PATENT DOCUMENTS

DE 004317610 A1 * 12/1994

* cited by examiner

*Primary Examiner*—Milton Nelson, Jr.
(74) *Attorney, Agent, or Firm*—Shook, Hardy & Bacon LLP

(57) ABSTRACT

The present invention provides a height-adjustment mechanism for an armrest. In an embodiment, a height-adjustment mechanism for an armrest includes an integral one-piece leverage body, and an integral one-piece sleeve. In an embodiment, the integral one-piece sleeve has pivot seats formed on a pair of locking arms depending from a first wall of the sleeve. These parts may be made of low cost materials suitable for integrally forming their features in an injection-moulding operation. Various features built into these parts may provide a user with a sense of quality.

24 Claims, 6 Drawing Sheets

HEIGHT-ADJUSTMENT MECHANISM FOR AN ARMREST

BACKGROUND OF THE INVENTION

The present invention relates generally to adjustable chairs, and more particularly to a height-adjustment mechanism for an armrest.

Various designs for height-adjustable armrests are known. Some known designs require numerous parts and relatively expensive materials, making such designs less cost competitive. Other known designs include relatively few parts, making them generally less expensive, but such designs may not appear to be of a high quality.

For example, U.S. Pat. No. 5,318,347 issued to Tseng ("Tseng '347") discloses a design for a height-adjustable armrest unit comprising an L-shaped support bar, a vertical sleeve, and a leverage body. In Tseng '347, a tongue provided at a lower end of the leverage body is adapted to engage a positioning hole located on the support bar. The leverage body may be pivoted to disengage the tongue from the positioning hole to allow the sleeve (and the leverage body) to be vertically adjusted relative to the support bar. While Tseng '347 may reduce product cost with fewer parts, the design may not provide a user with a sense that the armrest adjustment mechanism is of a high quality.

Consequently, what is needed is a height-adjustment mechanism for an armrest which can be manufactured at a low cost, yet is long-lasting and capable of giving a user a sense of high quality.

SUMMARY OF THE INVENTION

The present invention provides a height-adjustment mechanism for an armrest. In an embodiment, the height-adjustment mechanism includes an integral, one-piece leverage body; and an integral, one-piece sleeve. These parts may be made of low cost materials suitable for integrally forming their features in an injection moulding operation. Various features built into these parts may provide a user with a sense of quality.

In an embodiment, the integral one-piece sleeve has pivot seats formed on a pair of locking arms depending from a first wall of the sleeve.

The pivot seats may be suitably shaped to receive pivot pins and facilitate rotation of the pivot pins therein.

The pivot seats may be generally U-shaped and inclined downwardly, such that pivot pins receive therein are prevented from being unseated when pulled upwardly.

The locking arms may extend upwardly and cant away from the first wall of the sleeve.

The locking arms may be sufficiently resiliently flexible to facilitate snap-fitting of pivot pins between the locking arms and an inner wall of the sleeve.

The sleeve may be made of a material suitable for integrally forming the locking arms in an injection-moulding operation.

The leverage body may have a handle, a resilient biasing member projecting forwardly, a tongue projecting rearwardly, and a pair of pivot pins projecting from opposite sides, the pivot pins being seated in the pivot seats.

The leverage body may be elongate, with the handle being located at an upper portion of the body, the tongue being located at a lower portion of the body, and the pair of pivot pins being located intermediately between the handle and the tongue.

The resilient biasing member may project forwardly to engage the first wall of the sleeve and bias the pivot pins rearwardly into the pivot seats when a neck of the leverage body abuts the first wall of the sleeve.

The leverage member may be made of a material suitable for integrally forming the handle, the resilient biasing member, the tongue and the pivot pins in an injection-moulding operation.

Anti-rattling fingers may be provided to prevent rattling between the various parts of the height-adjustment mechanism.

These and other aspects of the invention will become apparent through the illustrative figures and accompanying description provided below.

BRIEF DESCRIPTION OF THE DRAWINGS

In the figures which illustrate example embodiments of this invention.

DETAILED DESCRIPTION

Figure 1:
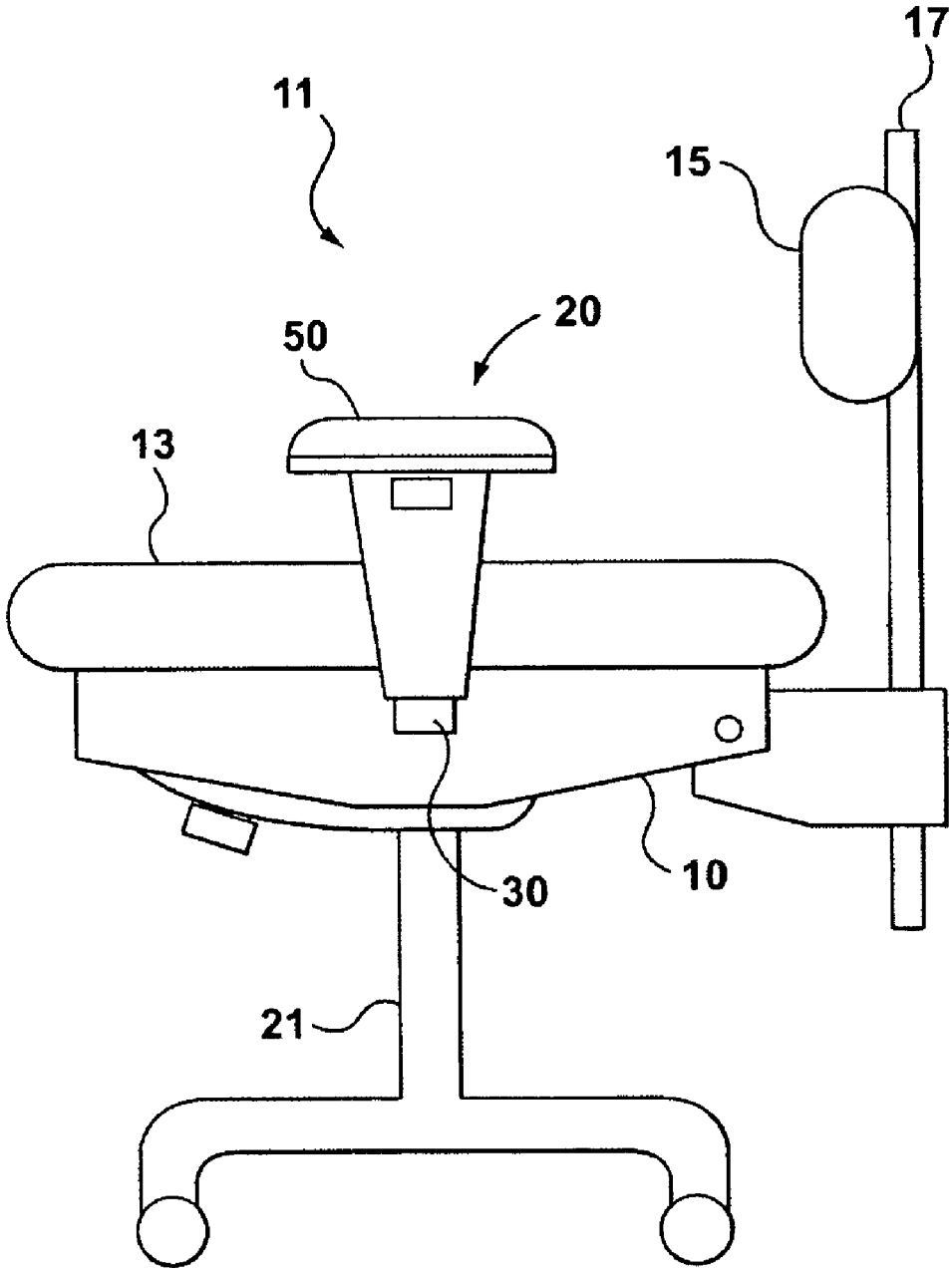
FIG. 1 is a view of an illustrative chair that may embody the invention.

Referring to FIG. 1, shown is an illustrative chair 11 that may embody the present invention. The chair 11 has a chair seat 13 mounted on a chair seat frame 10 and supported by a chair seat support 21. A backrest 15 is supported on a backrest support 17, and the backrest support 17 is mounted on the chair seat frame 10. The chair 11 may further include a pair of armrests, each armrest including a height-adjustment mechanism 20 supported on an armrest support 30.

Figure 2:
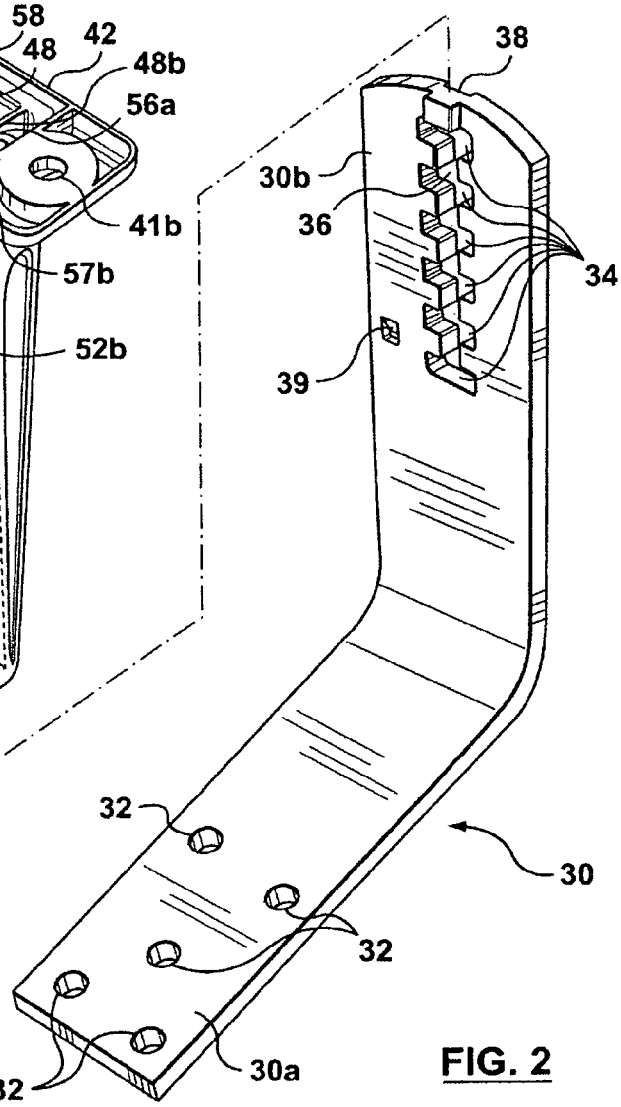
FIG. 2 is an exploded perspective view of a height-adjustment mechanism for an armrest in accordance with an embodiment of the invention.

FIG. 2 shows an exploded perspective view of a height-adjustment mechanism 20, in accordance with an exemplary embodiment of the invention. As shown, the height-adjustment mechanism 20 may include a sleeve 40 and a leverage body 60. The sleeve 40 and leverage body 60 are adapted to mount to and engage the armrest support 30, as explained below.

In the exemplary embodiment, the support 30 is an L-shaped bar having a first arm 30*a* and a second arm 30*b*. In use, the first arm 30*a* is generally horizontally oriented and may include a plurality of mounting holes 32 for mounting the support 30 to the chair seat frame 10 (using mounting screws, not shown). The generally vertically oriented second arm 30*b* of the support 30 may include a plurality of vertically spaced slots 34. In an embodiment, a vertical groove 36 may join all of the slots 34. As will be explained further below, a protruding tongue 64 formed on a lower portion of the leverage body 60 is adapted to selectively engage one of the slots 34, and the vertical position of the slot 34 engaged by the tongue 64 will determine the vertical position of the height-adjustment mechanism 20.

In order to support the height-adjustment mechanism 20, and the weight placed on the height-adjustment mechanism 20 by an occupant of the chair 11, the support 30 should be made of a sufficiently strong and rigid material. For example, in the exemplary embodiment, an elongate plate made of steel, or another suitable metal, may be used. Other materials such as reinforced plastics and carbon composites may also be used.

Still referring to FIG. 2, the sleeve 40 may be formed as an integral, single-piece, injection-moulded structure. For example, the sleeve 40 may be formed of a plastic material that may be injection-moulded in the desired shape. As shown, the sleeve 40 is adapted to be vertically oriented in use and has an upper end 42 and a lower end 43. The lower end 43 of the sleeve 40 has an opening 44 suitably sized to receive the generally vertically oriented second arm 30*b* of the armrest support 30. The upper end 42 of the sleeve 40 is suitably shaped to receive an armrest pad 50 (FIG. 1). Mounting holes 41*a* and 41*b* are provided at the upper end 42 of the sleeve 40 to mount the armrest pad 50 (using mounting screws, not shown).

Still referring to FIG. 2, the sleeve 40 is shown in a partial cutout view with an arrangement of structural reinforcing ribs located on each inside wall of the sleeve 40. A first pair of reinforcing ribs 48*a*, 48*b* is located on a first inside wall 48 of the sleeve 40. A second pair of reinforcing ribs 52*a*, 52*b* is provided on an opposite inside wall 52 of the sleeve 40. Additional reinforcing ribs 54*a* and 56*a* are provided on inner side walls 54 and 56, respectively, which extend between the first and second walls 48 and 52.

Together, the edges of the reinforcing ribs 48*a*, 48*b*, 52*a*, 52*b*, 54*a* and 56*a* form a "channel" 45. As shown, the channel 45 is aligned with opening 44 to slidably receive the vertically oriented second arm 30*b* of the support 30.

Still referring to FIG. 2, a notch 58 is provided at the top of the first wall 48 of the sleeve 40. As shown, the notch 58 is suitably sized to allow a portion of the leverage body 60, namely the handle 68, to extend outside the sleeve 40.

Still referring to FIG. 2, the leverage body 60 is formed as an integral, single-piece, injection-moulded body. For example, the leverage body 60 may be made of a plastic material injection-moulded into the desired shape. In the exemplary embodiment, the leverage body has a generally elongate body with a pair of pivot pins 62*a*, 62*b* located intermediately along its length. The tongue 64, as mentioned earlier, protrudes from a lower portion of the elongate leverage body 60. Also, a biasing member 66 of the leverage body 60 extends outwardly in a direction opposite the tongue 64. As mentioned, a handle 68 is provided at an upper end of the leverage body 60. The handle 68 allows an operator to pivot the leverage body 60 about the pivot pins 62*a*, 62*b*. In operation, the biasing member 66 provides a biasing force, acting against the force applied by the operator to the handle 68 of the leverage body 60.

Figure 2A:
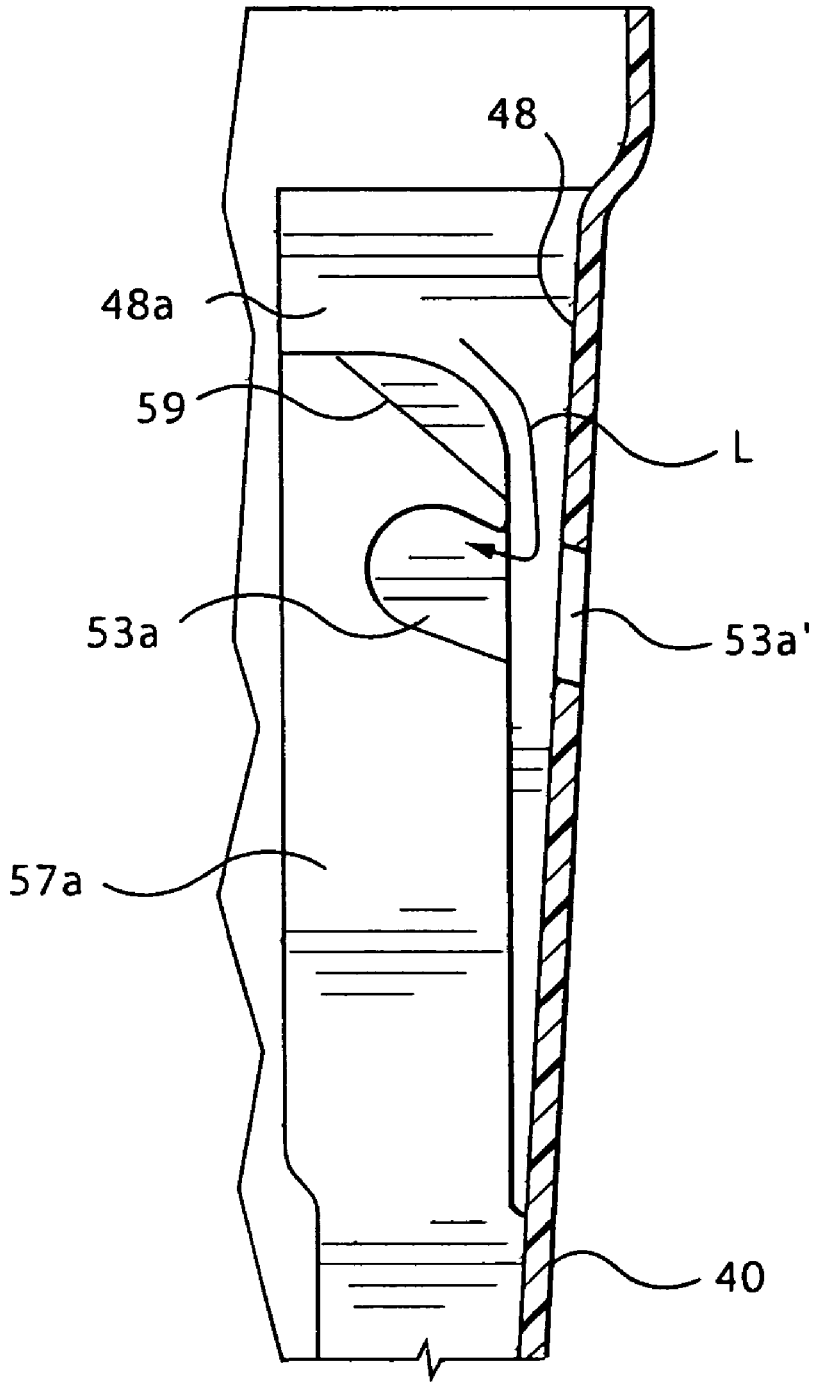
FIG. 2A is a detailed view of a locking arm depending from a first wall of a sleeve in the height-adjustment mechanism of FIG. 2.

Referring now to FIG. 2A, and still referring to FIG. 2, depending from the first wall 48 of the sleeve 40 are first and second locking arms 57*a* and 57*b* having pivot seats 53*a* and 53*b* formed therein. As shown in FIG. 2, these locking arms 57*a* and 57*b* are suitably positioned to receive the pivot pins 62*a*, and 62*b* of leverage body 60. As shown in FIG. 2A, the pivot seats 53*a* and 53*b* formed on the locking arms 57*a* and 57*b* open towards the first wall 48.

In the exemplary embodiment, the sleeve 40 is formed as an integral, single-piece, injection-moulded structure. The pivot seats 53*a* and 53*b* are formed into the inner sides of vertically oriented locking arms 57*a*, 57*b*, which are themselves integrally formed with the sleeve 40 by injection-moulding. As will be appreciated by those skilled in the art, the pivot seats 53*a*, 53*b* may be formed by the use of auxiliary mould inserts (not shown) inserted into an injection-moulding cavity for forming sleeve 40. For example, an extractable pair of moulding pins may be inserted into the injection-moulding cavity for forming sleeve 40 at an angle offset from the main axis of separation of the injection mould for forming sleeve 40. In an embodiment, access holes—only one of which, 53*a*' is shown—may be formed in the first wall 48 of the sleeve 40 as a result of the pair of moulding pins being inserted into the injection-moulding cavity while forming sleeve 40.

Still referring to FIG. 2A, the pivot pins 62*a*, 62*b* of the leverage body 60 may be received in the pivot seats 53*a*, 53*b* by fitting the pivot pins 62*a*, 62*b* in between the locking arms 57*a*, 57*b* and the first wall 48 of the sleeve 40, as shown at L. In the exemplary embodiment, a ramp 59 may be provided on each locking arm 57*a*, 57*b* to facilitate fitting the pivot pins 62*a*, 62*b* into the pivot seats 53*a*, 53*b* during assembly.

In an embodiment, each of the locking arms 57*a*, 57*b* and, optionally, the wall 48 may be somewhat resilient to permit the pivot pins 62*a*, 62*b* to be snap fit past the top of the ramps 59, and into the pivot seats 53*a*, 53*b* formed in the locking arms 57*a*, 57*b*. However, the locking arms 57*a*, 57*b* and the wall 48 should be sufficiently strong such that, once seated in the pivot seats 53*a*, 53*b*, the leverage body 60 is firmly secured in position for subsequent pivoting operations by an operator.

In an embodiment, the pair of pivot seats 53*a*, 53*b* may be formed at a suitable downwardly directed angle, relative to a notional horizontal plane passing through the sleeve 40, such that operation of the leverage body 60 by an operator in a lifting manner (as described below and best shown in FIG. 4) will not inadvertently unseat the pivot pins 62*a*, 62*b* from the pivot seats 53*a*, 53*b*.

In an embodiment, the locking arms 57*a*, 57*b* may extend upwardly and cant away from the first wall 48.

The height adjustment operation of the height-adjustment mechanism 20 will now be explained.

Figure 3:
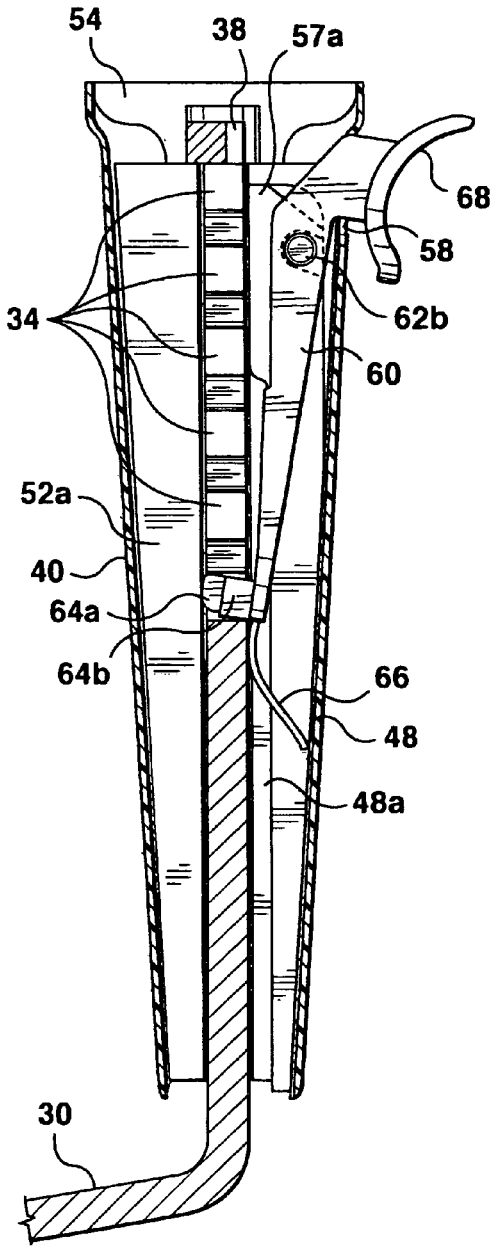
FIG. 3 is a cross sectional side view of the height-adjustment mechanism of FIG. 2 showing the leverage body in a first position.

Referring to FIG. 3, the sleeve 40 is shown mounted on the vertically oriented second arm 30*b* of the armrest support 30. The leverage body 60 is shown with its pivot pins 62*a* and 62*b* seated within the pivot seats 53*a* and 53*b* and secured thereat by the locking arms 57*a*, 57*b*.

As shown, with the neck 67 of body 60 abutting the base of notch 58, the biasing arm 66 of the leverage body urges the pivot pins 62*a*, 62*b* into the pivot seats 53*a*, 53*b* to keep the pivot pins 62*a*, 62*b* seated therein.

As shown in FIG. 3, the handle 68 of the leverage body 60 extends through the notch 58 in the first wall 48 of sleeve 40. Within the sleeve 40, the biasing arm 66 of leverage body 60 engages the first wall 48 and biases the leverage body 60 away from the first wall 48. When the leverage body 60 is not pivoted by an operator, the biasing force provided by the biasing arm 66 causes the tongue 64 protruding from the lower portion of the leverage body 60 to continuously engage one of the slots 34 in the support 30. As noted earlier, the vertical position of the slot 34 engaged by the tongue 64 determines the vertical height of the height-adjustment mechanism 20.

Figure 4:
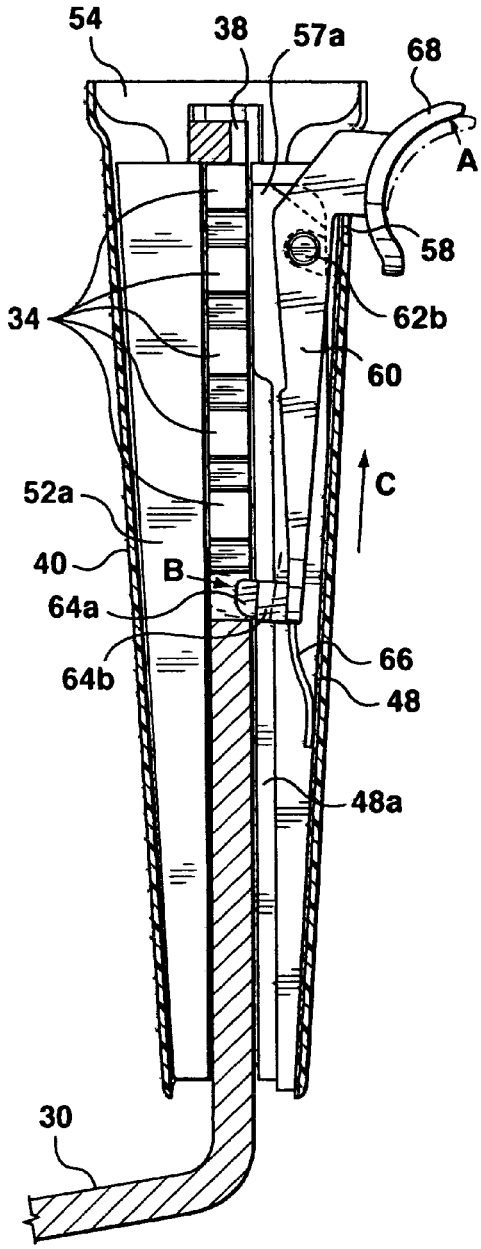
FIG. 4 is the cross sectional side view of FIG. 3 showing the leverage body in a second position.

As shown in FIG. 4, in order to adjust the height of the height-adjustment mechanism 20, the handle 68 of leverage body 60 may be lifted or pulled back by an operator in direction A. This action by the operator will cause the leverage body 60 to pivot about pivot pins 62*a* and 62*b*, against the biasing force of the resiliently flexible biasing arm 66. The biasing arm 66 is resiliently deformed when the handle 68 is lifted by the operator such that the biasing arm 66 will act to reengage the tongue 64 with one of the slots 34 when the handle 68 is released.

In one embodiment, the tongue 64 includes a base 64*a*, and a tip 64*b*. As shown, when the leverage body 60 is pivoted about pivot pins 62*a* and 62*b*, the base 64*a* of the tongue 64 disengages from the slots 34, as shown at B. However, the tip 64*b* of the tongue 64 remains engaged in the vertical groove 36 (FIG. 2). As the vertical groove 36 runs the length of the slots 34, the leverage body 60 and the sleeve 40 may be adjusted vertically, as indicated at C, relative to the support 30. The tongue 64 continuously guides the leverage body 60 within the vertical groove 36, thereby allowing the base 64*a* of tongue 64 to more readily engage any one of the slots 34 when the operator finally releases the handle 68.

In an embodiment, the vertical adjustment of the height-adjustment mechanism 20 by the operator may be limited at an upper and lower limit by the tip 64*b* of the tongue 64 engaging the top and bottom of the slot 36.

Figure 5A:
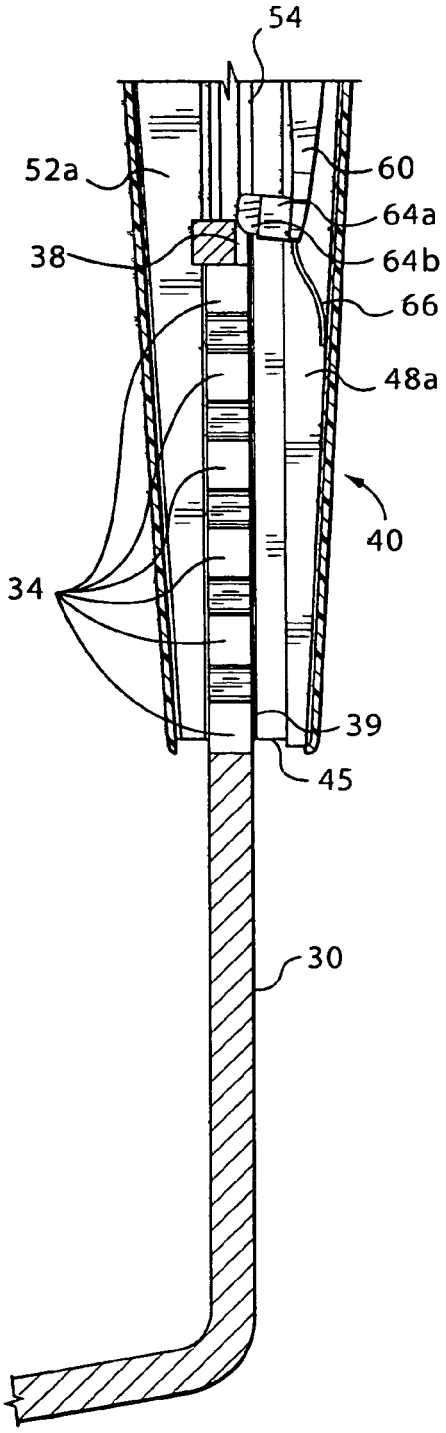
FIG. 5A is a cross sectional side view of a portion of FIG. 2.

Referring to FIG. 5A, in an embodiment, an offset 38 may be formed in the support 30 at the top of the vertical groove 36 to accommodate and guide the tip 64*b* of the tongue 64 of the leverage body 60 when the height-adjustment mechanism 20 is first slidably received on the support 30. When this offset 38 is provided, a separate feature may be provided to limit vertical adjustment of the height-adjustment mechanism 20. For example, a protuberance 39 (seen from the back in FIG. 2) may be formed and suitably located on the vertically oriented second arm 30*b* of the support 30. The protuberance 39 may be ramped in a downward direction such that an inwardly extending part 45 of sleeve 40 will deform and pass over the protuberance 39 on the way down, when the sleeve 40 is first installed, but the inwardly extending part 45 of sleeve 40 will catch on the protuberance 39 on the way up. Thus, the protuberance 39 may prevent the height-adjustment mechanism 20 from being inadvertently lifted clear off the support 30 by the operator.

Figure 5B:
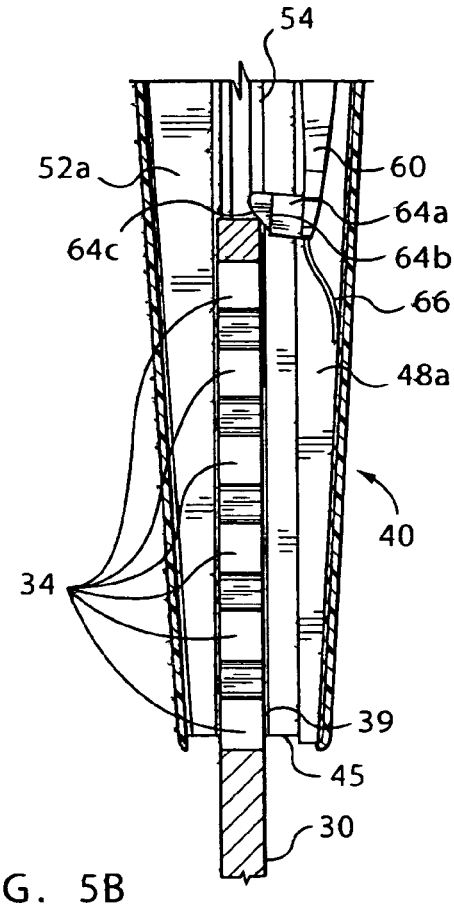
FIG. 5B is a cross sectional side view of another embodiment of this invention.

Referring to FIG. 5B, as shown in this alternative embodiment, the offset 38 of FIG. 5A may be absent. In this case, in order to assist in fitting the tip 64*b* of the tongue 64 over the top of the support 30 and into the vertical groove 36 (FIG. 2) during assembly, a ramped surface 64*c* may be provided on the lower portion of the tip 64*b*. As the tip 64*b* otherwise remains the same, the tip 64*b* having the ramped surface 64*c* may continue to engage the vertical groove 36, as described above.

Figure 6:
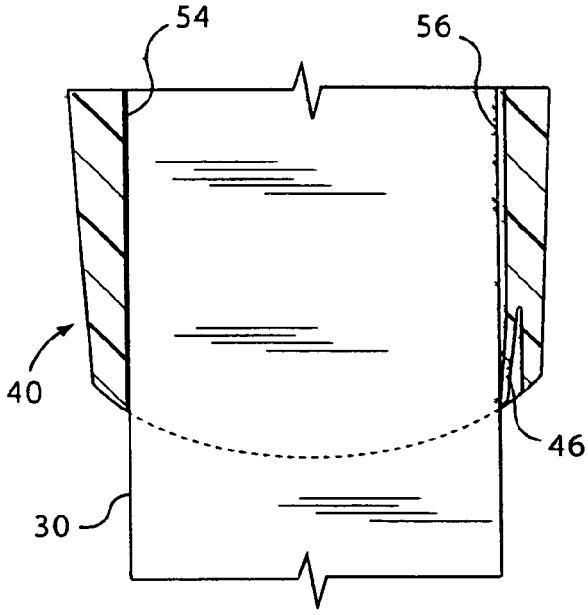
FIG. 6 is a cross sectional front view of a portion of the height-adjustment mechanism of FIG. 2 showing a feature detail of yet another embodiment of the invention.

Referring to FIG. 6, in a further embodiment, a flexibly resilient anti-rattling finger 46 may be formed on one of the inner side walls 54, 56 of the sleeve 40 to flexibly bias the support 30 against the opposite one of the inner side walls 54, 56 of the sleeve 40. In operation, the anti-rattling finger 46 acts to reduce or prevent rattling between the sleeve 40 and the support 30, providing the operator of the height-adjustment mechanism 20 with a more smooth and solid feel.

Advantageously, as the locking arms 57*a*, 57*b* are formed integrally with the sleeve 40, no separate locking member is required to secure the leverage body 60 in position. Also, the provisioning of a biasing member 66 on the leverage body 60 facilitates secure seating of the pivot pins 62*a*, 62*b* within the pivot seats 53*a*, 53*b*, and prevents rattling between the two pieces. Consequently, a two-piece height-adjustment mechanism, with each piece being formed as an integral, one-piece, injection-moulded structure, provides a completely functional design that may provide a user with a sense of high quality.

Furthermore, the height-adjustment mechanism 20 may be readily assembled in a single step, and may be shipped as a ready-to-install, assembled unit. Alternatively, each of the leverage body 60 and the sleeve 40 may be shipped unassembled, and may be readily assembled in the field. Also, either item may be readily replaced in the field at the end of the item's useful life. More particularly, locking arms 57*a*, 57*b* may be manually displaced to free body 60 from sleeve 40.

Figure 7A:
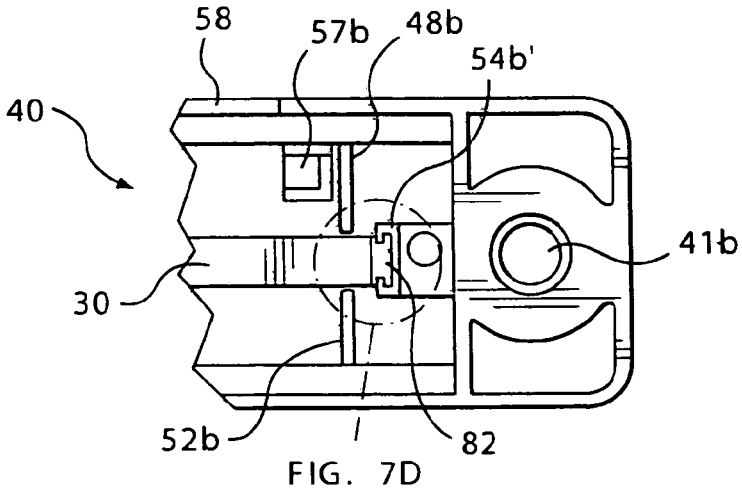
FIGS. 7A–7D are views of a feature detail of yet another embodiment of the invention.
Figure 7B:
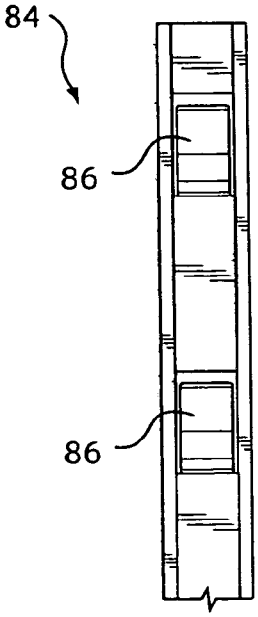
Figure 7C:
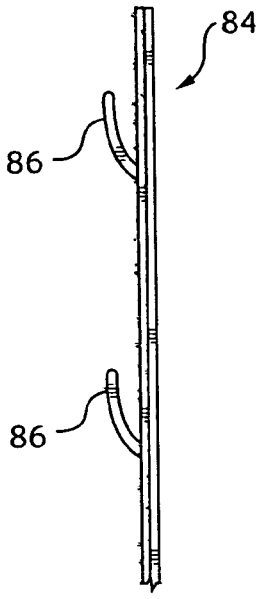
Figure 7D:
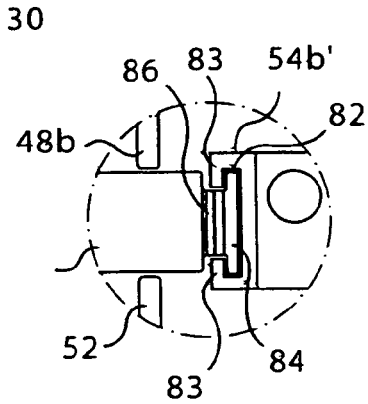

Referring to FIGS. 7A–7D, in a further embodiment, rather than moulding a resilient finger 46 in sleeve 40, the sleeve 40 may be moulded to include a track 82 along a length of a reinforcing rib 54*b*'. As shown in FIG. 7D, the track 82 may have retaining walls 83 to retain an insert 84 having a plurality of projecting anti-rattling fingers 86. The anti-rattling fingers 86 extend to abut an edge of the support 30. The anti-rattling fingers 86 are resiliently flexible and may be suitably shaped and sized so they will push the support 30 against the opposite side of the channel 45 (FIG. 2) of sleeve 40 to remove any tolerances between the sleeve 40 and the support 30. In this regard, the insert 84 may be made integrally formed of a resilient plastic material. Advantageously, the anti-rattling fingers 86 may provide a smooth gliding action when the height-adjustment mechanism 20 is adjusted.

Figure 8:
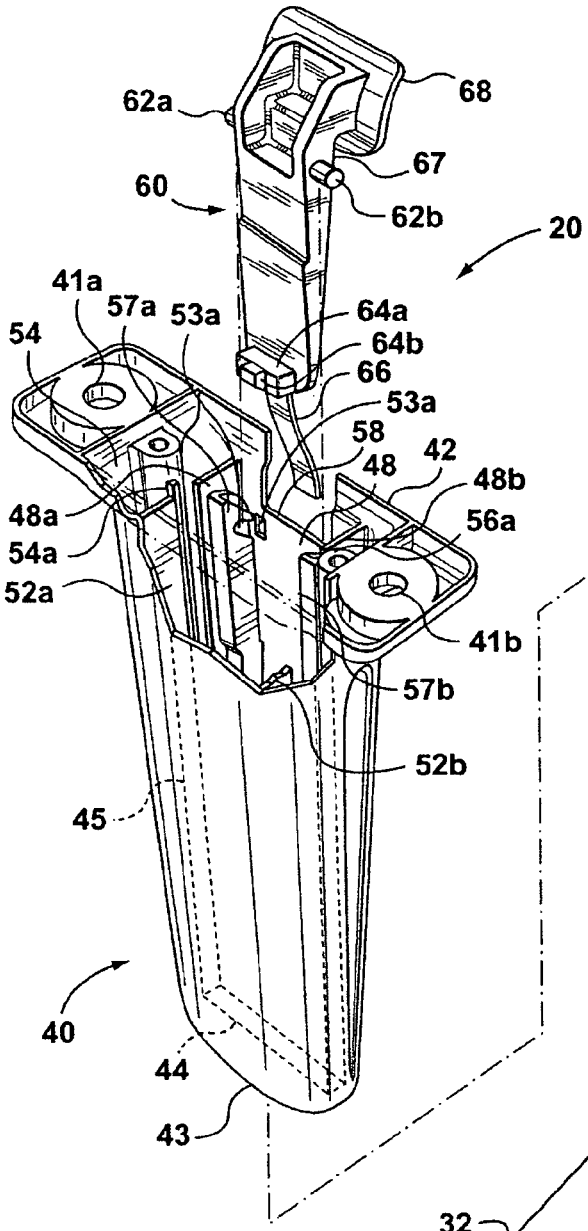
FIG. 8 is a perspective view of another embodiment of the leverage body of FIG. 2.
Figure 8:
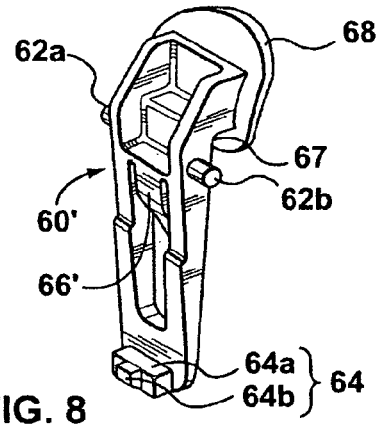

In yet another embodiment, as shown in FIG. 8, an alternative leverage body 60' has a biasing member 66' extending from an intermediate region, rather than extending from a bottom end as shown at 60 in FIG. 2. It will be apparent that this alternative leverage body 60' is interchangeable with the leverage body 60 of FIG. 2. It will also be apparent that a biasing member may be integrally formed on the leverage body 60 at various other locations, and that such a biasing member may be embodied in various other configurations.

While an exemplary embodiment of the invention has been shown and described, it will be apparent to those skilled in the art that various modifications and alterations may be made. Therefore, the invention is defined in the following claims.

What is claimed is:

1. A height adjustment mechanism for an armrest, comprising: an integral one-piece sleeve having pivot seats formed on a pair of locking arms depending from a first wall of said sleeve wherein said pivot seats are suitably shaped to receive pivot pins and facilitate rotation of pivot pins therein and wherein said pivot seats incline downwardly so as to open downwardly, such that pivot pins received therein are prevented from being unseated when pulled upwardly and wherein said locking arms extend upwardly and cant away from said first wall of said sleeve.

2. The height-adjustment mechanism of claim 1, wherein said pivot seats are generally U-shaped.

3. The height-adjustment mechanism of claim 1, wherein said sleeve is made of a material suitable for integrally forming said locking arms in an injection-moulding operation.

4. The height-adjustment mechanism of claim 3, wherein said material is a plastic.

5. A height adjustment mechanism for an armrest, comprising: an integral one-piece sleeve having pivot seats formed on a pair of locking arms depending from a first wall of said sleeve wherein said pivot seats are suitably shaped to receive pivot pins and facilitate rotation of pivot pins therein and wherein said pivot seats incline downwardly so as to open downwardly, such that pivot pins received therein are prevented from being unseated when pulled upwardly and wherein said locking arms are sufficiently resiliently flexible to facilitate snap-fitting of pivot pins between said locking arms and an inner wall of said sleeve.

6. The height-adjustment mechanism of claim 5, further comprising ramps provided at the top of said locking arms to guide said pivot pins into said pivot seats during assembly.

7. A height adjustment mechanism for an armrest, comprising: an integral one-piece sleeve having pivot seats formed on a pair of locking arms depending from a first wall of said sleeve wherein said pivot seats are suitably shaped to receive pivot pins and facilitate rotation of pivot pins therein and wherein said pivot seats incline downwardly so as to open downwardly, such that pivot pins received therein are prevented from being unseated when pulled upwardly and further including a leverage body having a handle, a resilient biasing member projecting forwardly, a tongue projecting rearwardly, and a pair of pivot pins projecting from opposed sides, said pivot pins being seated in said pivot seats.

8. The height-adjustment mechanism of claim 7, wherein said leverage body is made of a material suitable for integrally forming said handle, said resilient biasing member, said tongue and said pivot pins in an injection-moulding operation.

9. The height-adjustment mechanism of claim 8, wherein said material is a plastic.

10. The height-adjustment mechanism of claim 7, wherein said leverage body is elongate, said handle being located at an upper portion of said body, said tongue being located at a lower portion of said body, and said pair of pivot pins being located intermediately between said handle and said tongue.

11. The height-adjustment mechanism of claim 10, wherein said biasing member is a depending finger.

12. The height-adjustment mechanism of claim 11, wherein said depending finger is attached between said pair of pivot pins and said tongue.

13. The height-adjustment mechanism of claim 11, wherein said depending finger is attached at a lower end of said body.

14. The height-adjustment mechanism of claim 7, further including a support and a plurality of ribs extending from inner walls of said sleeve to form a channel slidably receiving said support.

15. The height-adjustment mechanism of claim 14, wherein said support includes a plurality of spaced slots and receives said tongue of said leverage body in one of said slots, said leverage body being operable by an operator to disengage said tongue from said one of said slots for height-adjustment of said mechanism.

16. The height-adjustment mechanism of claim 15, wherein said biasing member projects forwardly to engage said first wall of said sleeve and biases said tongue rearwardly, towards said slots on said support.

17. The height-adjustment mechanism of claim 16, wherein a vertical groove joins all of said slots on said support.

18. The height-adjustment mechanism of claim 17, wherein said tongue of said leverage body includes a base and a tip, and said tip of said tongue is adapted to continuously engage said vertical groove when said base of said tongue is disengaged from said slots during height-adjustment of said mechanism by an operator.

19. The height-adjustment mechanism of claim 18, wherein said tip of said tongue includes a ramped surface on its lower portion to assist, during assembly, in fitting said tip of said tongue over said support and into said vertical groove.

20. The height-adjustment mechanism of claim 14, further including an anti-rattling finger formed on one side of said channel, said anti-rattling finger biasing said support against another side of said channel in order to reduce rattle.

21. The height-adjustment mechanism of claim 14 wherein said leverage body is elongate, said handle being located at an upper portion of said body, said tongue being located at a lower portion of said body, and said pair of pivot pins being located intermediately between said handle and said tongue, and further including a track on one side of said channel, and an insert with an anti-rattling finger retained in said track, said anti-rattling finger extending to bias said support against another side of said channel in order to reduce rattle.

22. The height-adjustment mechanism of claim 7, wherein said biasing member projects forwardly to engage said first wall of said sleeve and biases said pivot pins rearwardly into said pivot seats when a neck of said leverage body abuts said first wall of said sleeve.

23. The height-adjustment mechanism of claim 22, wherein said pivot seats are generally U-shaped.

24. The height-adjustment mechanism of claim 23, wherein said locking arms extend upwardly and cant away from said first wall of said sleeve.

* * * * *